US006732404B2

(12) United States Patent
Fukuoka et al.

(10) Patent No.: US 6,732,404 B2
(45) Date of Patent: May 11, 2004

(54) ELECTRIC VACUUM CLEANER HAVING EXHAUST AIR RETURN FEATURE

(75) Inventors: Hidetoshi Fukuoka, Hyogo-ken (JP); Nobuaki Takahashi, Kasai (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/730,706

(22) Filed: Dec. 6, 2000

(65) Prior Publication Data

US 2001/0003853 A1 Jun. 21, 2001

(30) Foreign Application Priority Data

Dec. 15, 1999 (JP) ..... 11-356060

(51) Int. Cl.[7] ..... A47L 5/14
(52) U.S. Cl. ..... 15/346; 15/377
(58) Field of Search ..... 15/346, 377

(56) References Cited

U.S. PATENT DOCUMENTS

| | | | | | |
|---|---|---|---|---|---|
| 3,694,848 | A | | 10/1972 | Alcala | 15/346 |
| 4,393,536 | A | | 7/1983 | Tapp | 15/346 |
| 5,331,715 | A | | 7/1994 | Johnson et al. | 15/332 |
| 5,553,347 | A | | 9/1996 | Inoue et al. | 15/346 |
| 5,613,269 | A | * | 3/1997 | Miwa | 15/346 |
| 6,010,561 | A | * | 1/2000 | Dyson | 15/347 |
| 6,032,327 | A | * | 3/2000 | Oka et al. | 15/346 |
| 6,237,188 | B1 | | 5/2001 | Takemoto et al. | 15/346 |
| 6,243,915 | B1 | * | 6/2001 | Nakai et al. | 15/346 |
| 6,324,722 | B1 | * | 12/2001 | Takemoto | 15/346 |
| 6,345,411 | B1 | * | 2/2002 | Kato et al. | 15/346 |
| 6,591,446 | B2 | * | 7/2003 | Bair et al. | 15/347 |

FOREIGN PATENT DOCUMENTS

| | | | |
|---|---|---|---|
| CA | 972510 | 8/1975 | 15/346 |
| CA | 977910 | 11/1975 | 15/346 |
| GB | 2 292 882 | 3/1996 | |

* cited by examiner

*Primary Examiner*—Theresa T. Snider
(74) *Attorney, Agent, or Firm*—Darby & Darby

(57) ABSTRACT

Pressurized filtered exhaust air from a motorized fan in a vacuum cleaner body passes on an exhaust path to a floor suction tool. The exhaust air is directed by the floor suction tool generally parallel to the surface to be cleaned to agitate dust and thus to improve cleaning performance. An electric motor in the floor suction tool drives a rotation brush. The exhaust air is also directed toward the rotation brush in the floor suction tool in a direction to add rotation force to the rotation brush. Feeder lines to the electric motor pass through the exhaust path so that the feeder lines are exposed only to filtered air. Passing the feeder lines through the exhaust path avoids the necessity to make special provision for the feeder lines. The exhaust path passes along a hose, and may optionally pass along one or more extension pipes on its way to the floor suction tool.

5 Claims, 15 Drawing Sheets

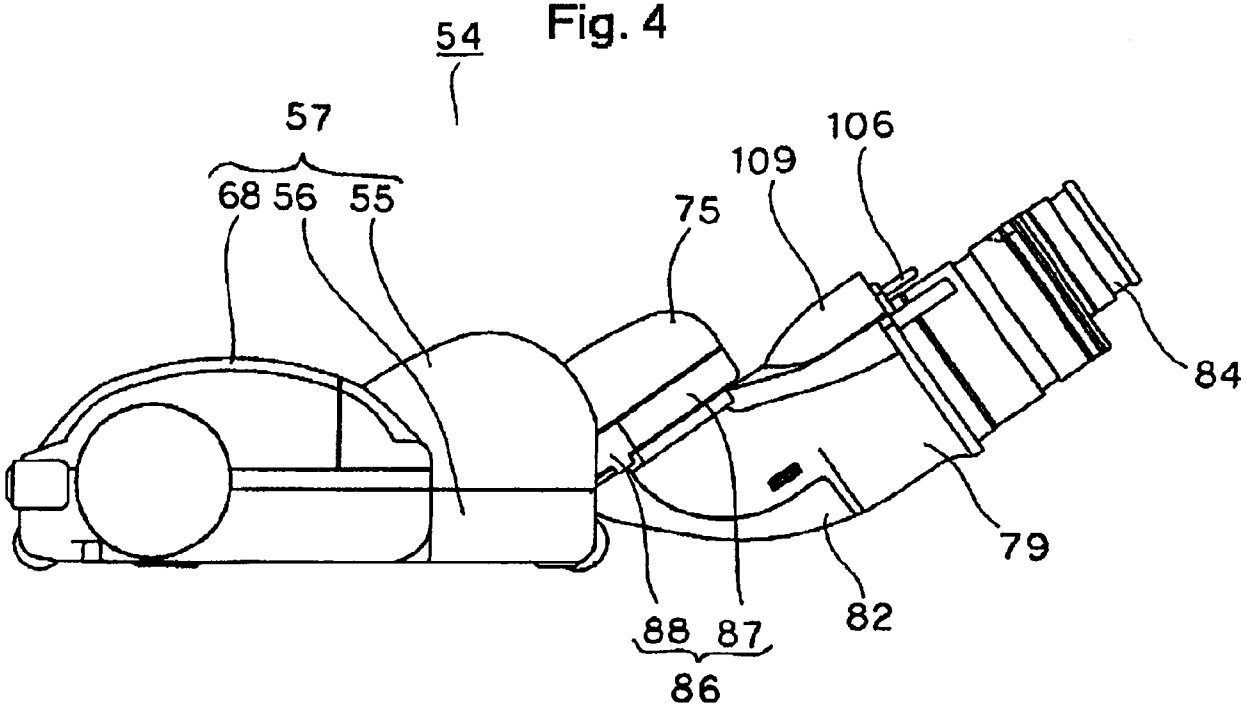
Fig. 4
Fig. 5
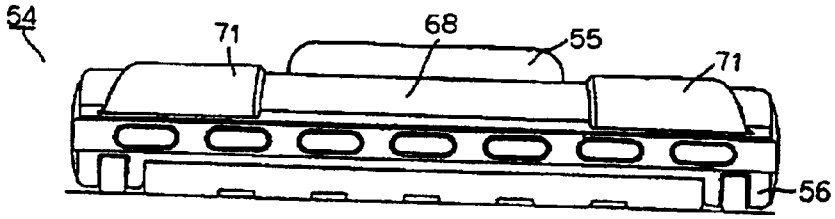

ELECTRIC VACUUM CLEANER HAVING EXHAUST AIR RETURN FEATURE

BACKGROUND TO THE INVENTION

The present invention relates to an electric vacuum cleaner of an exhaust reflux (circulation) type in which exhaust from a motorized fan internal to a vacuum cleaner body is circulated to a floor suction tool via hose and pipe.

Japanese Application Number 11-163986 proposes an electric vacuum cleaner, wherein air in a circulation path of exhaust from a motorized fan is circulated to a floor suction tool that has a rotatable rotation brush. The recirculated air is blown toward the surface to be cleaned inside the floor suctioning tool. The rotation brush of the floor tool is rotated by the exhaust to remove dust from the surface to be cleaned. The dirt is buoyed up by the air flow to make it easier to suction the dirt into the vacuum cleaner.

When a vacuum cleaner is used for cleaning a carpet with long fibers, the rotation brush may have insufficient rotational torque when the rotational force of the rotation brush relies only on the circulated exhaust. Dust deep inside the fibers of the carpet and the like may not be satisfactorily removed.

In order to solve this problem, there has been considered a construction wherein the floor suction tool has a separate electric motor that forcibly rotates the rotation brush. However, space for wiring the feeder lines to the motor is needed. If wiring space for feeder lines is provided on a floor suctioning tool with a two layer construction of a air suctioning path and exhaust path, the floor suctioning tool becomes large and difficult to use.

OBJECT AND SUMMARY OF THE INVENTION

In view of the above problems, the object of the present invention is to provide an electric vacuum cleaner that simplifies the construction of the floor suction tool and also improves its dust removing performance.

Briefly stated, the present invention provides a vacuum cleaner in which pressurized filtered exhaust air from a motorized fan in the vacuum cleaner body passes on an exhaust path to a floor suction tool. The exhaust air is directed by the floor suction tool generally parallel to the surface to be cleaned to agitate dust and thus to improve cleaning performance. An electric motor in the floor suction tool drives a rotation brush. The exhaust air is also directed toward the rotation brush in the floor suction tool in a direction to add rotation force to the rotation brush. Feeder lines to the electric motor pass through the exhaust path so that the feeder lines are exposed only to filtered air. Passing the feeder lines through the exhaust path avoids the necessity to make special provision for the feeder lines. The exhaust path passes along a hose, and may optionally pass along one or more extension pipes on its way to the floor suction tool.

According to an embodiment of the invention, there is provided an electric vacuum cleaner, comprising: a vacuum cleaner body containing a motorized fan, a floor suction tool, a rotation brush in said floor suction tool, a motor in said floor suction tool for rotating said rotation brush, an air circulation exhaust path from said vacuum cleaner body to said floor suction tool, said air circulation exhaust path including an air filter, whereby air in said air circulation exhaust path is clean air, electric lines from said vacuum cleaner body to said motor for rotating said rotation brush, and said electric lines passing along said air circulation exhaust path, whereby said electric lines are protected from contaminants in air moving therepast.

The first means of the present invention is an electric vacuum cleaner, comprising: a vacuum cleaner body containing an internal motorized fan; a flexible hose connected to the vacuum cleaner body; an extension pipe that is optionally connected to the hose; a floor suction tool that is connected to the extension pipe; a circulation path in which exhaust from the motorized fan is circulated to the floor suction tool via the hose and the extension pipe; a rotation brush and a motor that drives the rotation brush being provided on the floor suction tool; and feeder lines to the motor in the circulation path.

In the first means of the present invention, preferably, the floor suction tool is constructed from a suction tool body, a pivoting pipe that can be moved up and down with respect to the suction tool body, a connection pipe that can be pivoted in the circumferential direction with respect to the pivoting pipe; and the feeder lines are placed in the circulation path formed on the pivoting pipe and the connection pipe; and the feeder lines have more slack than the pivoting distance of the pivoting pipe and the connection pipe.

In the first means of the present invention, preferably, the exhaust air is guided to the rotation brush in the rotation direction of the rotation brush.

The above, and other objects, features and advantages of the present invention will become apparent from the following description read in conjunction with the accompanying drawings, in which like reference numerals designate the same elements.

BRIEF DESCRIPTION OF THE FIGURES

FIG. 4 is a side view of the floor suction tool of FIG. 2.

FIG. 5 is a front view of the floor suction tool of FIG. 2.

DESCRIPTION OF THE PREFERRED EMBODIMENTS

Figure 1:
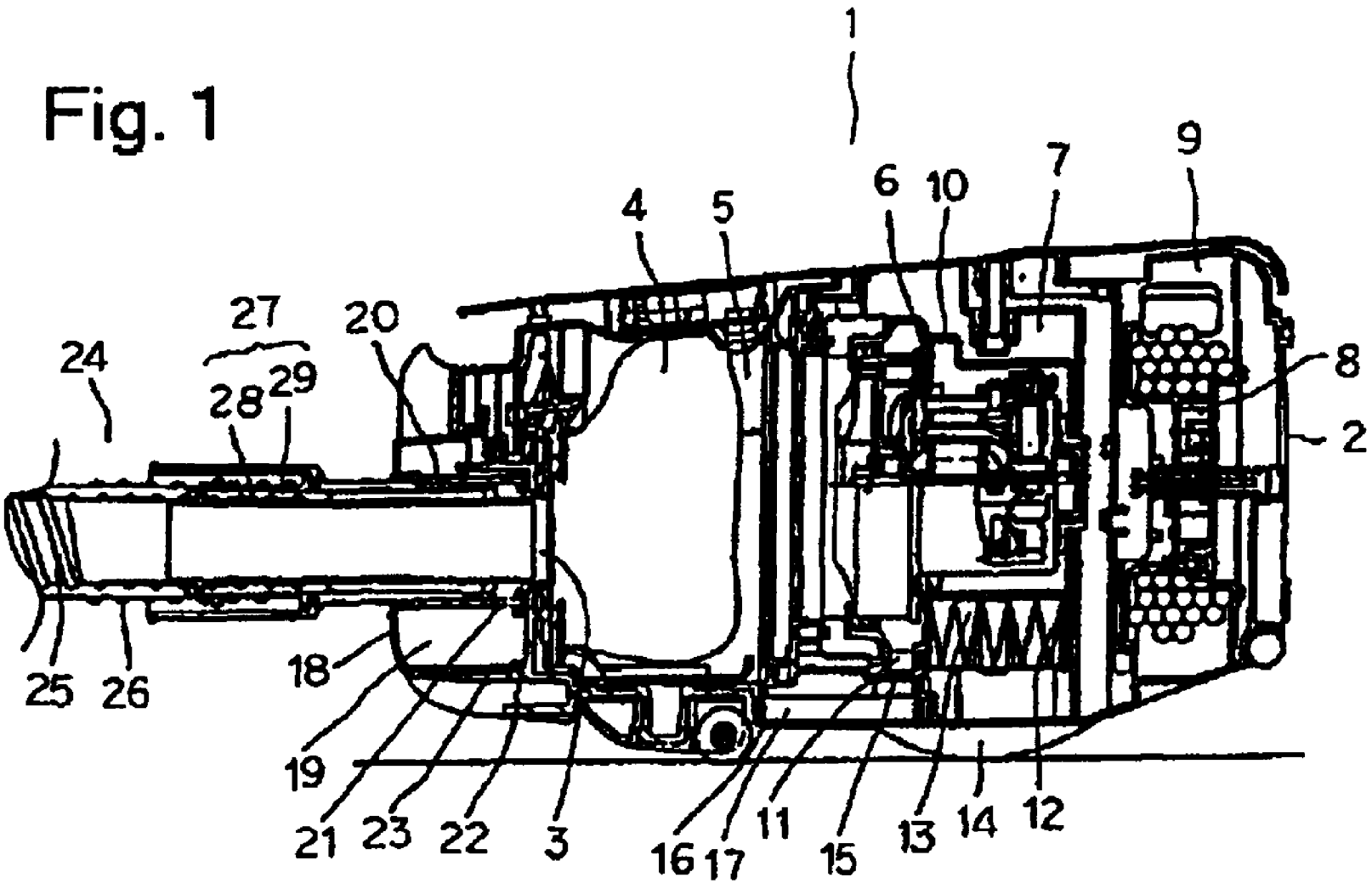
FIG. 1 is a cross-section of a vacuum cleaner body and a portion of a flexible hose of a vacuum cleaner according to an embodiment of the present invention.

Referring to FIG. 1, a vacuum cleaner body 1 is constructed from a body case 2. A cover 16 (described later) is attached to the outside bottom part of body case 2 to form an exhaust path 17 between it and body case 2. A front cover 18 (described later) is attached to the front part of body case 2.

Vacuum cleaner body 1 has a suction opening 3 on the front wall of body case 2. Going in order starting from the front of body case 2, vacuum cleaner body 1 is equipped with a dust collecting chamber 5 into which a paper pack 4 may be installed to filter dust from the air flow. Dust collecting chamber 5 is connected to suction opening 3. A motorized fan chamber 7 contains a motorized fan 6 for drawing air into vacuum cleaner 1. A cord reel chamber 9 contains a cord reel 8 for holding an electric cord, and from which the electric cord can be unreeled in a conventional manner.

Motorized fan 6 is covered by a motor cover 10. A first opening 11 in motor cover 10 is radially aligned with the fan of motorized fan 6. A second opening 12 in motor cover 10 is located at a position corresponding to the motor for motorized fan 6. A filter 13 is interposed in second opening 12. After passing through the motor, a portion of the exhaust from motorized fan 6 is discharged from motor cover 10 through filter 13 and then through an axle portion of a wheel 14 positioned on the side of body case 2.

A return opening 15 is formed on the bottom surface of motorized fan chamber 7. Return opening corresponds to first opening 11 of motor cover 10 that covers motorized fan 6. A portion of the exhaust from motorized fan 6 is guided via return opening 15 to exhaust path 17.

Cover 16 is attached to the outside bottom surface of body case 2. Exhaust path 17, through which exhaust from motorized fan 6 passes, is formed between cover 16 and the bottom surface of body case 2.

Front cover 18 is attached to the front part of body case 2. An exhaust space 19 is defined between front cover 18 and body case 2. A hose connection tube part 20 is positioned at a front of front cover 18, aligned with suction opening 3. A first connection member 27 of a hose 24 is fittable into hose connection tube part 20. A communication opening 21 is formed on a part of hose connection tube part 20. Communication opening 21 connects exhaust space 19 with the inside of hose connection tube part 20.

A partitioning wall 22 is formed facing forward on the bottom part of the front wall of body case 2. Partitioning wall 22 partitions exhaust path 17 and exhaust space 19. Exhaust path 17 and exhaust space 19 are connected by a communication hole 23 in partitioning wall 22.

Hose 24 is removably connected to hose connection tube part 20 at one end of vacuum cleaner body 1. Hose 24 has a two layer construction consisting of a smaller diameter inner hose 25 that has flexibility and an outer hose 26 that has a larger diameter than inner hose 25. The inside of inner hose 25 is a suction path. A space between inner hose 25 and outer hose 26 is an exhaust path. A coil of wire is embedded in outer hose 26. The coil of wire is electrically conductive and automorphic.

Inner hose 24 does not include support elements such as coil wires and the like embedded therein. Inner hose 24, being inside, and protected by outer hose 26, which does have a coil of wire embedded therein, is protected from deformation even if the user accidentally steps on hose 24. In the event of temporary deformation of inner hose 25, its shape is restored. As long as outer hose 26 is not deformed, inner hose 25 is not deformed. This prevents the build-up of dust and consequent clogging of inner hose 25. Furthermore, if outer hose 26 is deformed, it is recognized that inner hose 25 is also crushed. Thus, irregularities in the shape of inner hose 25, which may cause clogging of inner hose 25, are evident from ane external examination of outer hose 26.

In order to make the condition of inner hose 25 more observable, inner hose 25 is preferably of a colored resin material, and outer hose 26 is preferably of a semi-transparent resin.

First connection member 27 at the upper end of hose 24 has an inner 28 member to which inner hose 25 is connected, and an outer member 29 to which outer hose 26 is connected. After attaching inner hose 25 to inner member 28, outer hose 26 is attached and secured to outer member 29.

Inner member 28 of first connection member 27 protrudes further outward than outer member 29. When first connection member 27 is connected to hose connection tube part 20 on front cover 18 of vacuum cleaner body 1, an airtight connection is formed between inner member 28 and suction opening 3 of body case 2. Communication opening 21 on hose connection tube part 20 faces the surface of inner member 28 which protrudes more than outer member 29. Exhaust from exhaust space 19 flows between inner member 28 and outer member 29 of first connection member 27 via communication opening 21.

Figure 2:
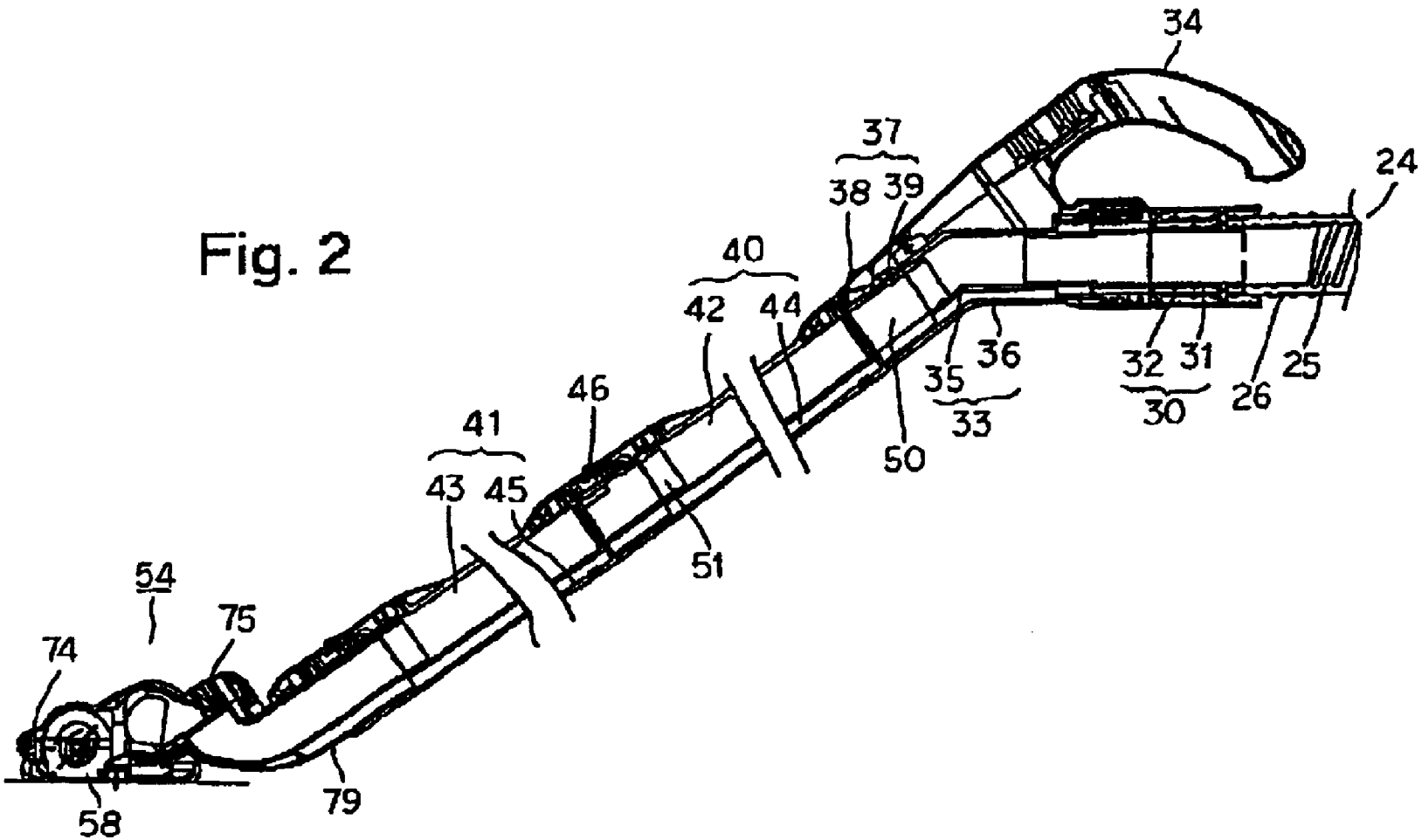
FIG. 2 is a cross-section of the flexible hose from a handle pipe to a floor suction tool.
Figure 3:
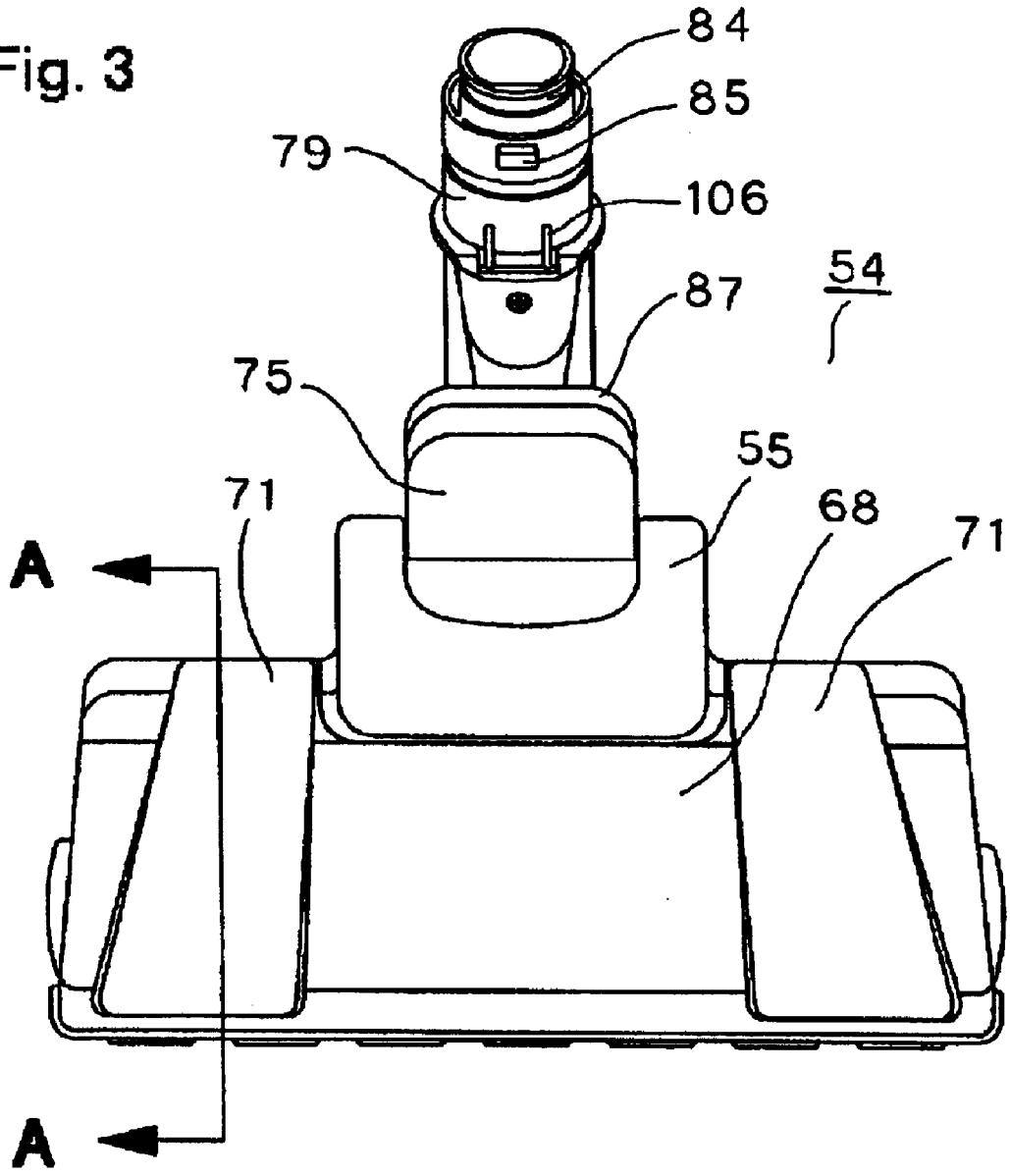
FIG. 3 is a top view of the floor suction tool of FIG. 2.

Referring now to FIG. 2, a second connection member 30 is located at the outer end of hose 24. As with first connection member 27, second connection member 30 has an inner member 31 that connects with inner hose 25 and an outer member 32 that connects with outer hose 26.

A grip part 34 is formed unitarily on the upper surface of a handle pipe 33. Second connection member 30, to which hose 24 is connected, is rotationally and electrically connected to handle pipe 33. Handle pipe 33 has an inner tubular part 35 that has an approximately circular cross section. Inner tubular part 35 aligns with inner member 31 of second connection member 30 to form a part of the suction path. An outer tubular part 36 covers the under side (opposite side from grip part 34) of inner tubular part 35. Outer tubular part 36 is in communication with outer member 32 of second connection member 30 to seal the exhaust path.

A clamp 37 is embedded on handle pipe 33 in a see-saw condition. A pushing part 38 is exposed at the top surface of one end of clamp 37 on handle pipe 33. In addition, a hook 39 on the other end of clamp 37 can be raised and lowered inside inner tubular part 35 through an opening (not shown) in inner tubular part 35.

A first extension pipe 40 and a second extension pipe 41 are removably attached to handle pipe 33. The shapes of first extension pipe 40 and second extension pipe 41 generally correspond to the shape of handle pipe 33. First extension pipe includes suction tube part 42 having a generally circular cross-section similar to inter tubular part 35. An exhaust tube part 44 on the lower side of first extension pipe 40 has an approximately crescent-shaped cross-section coinciding with the shape of outer tubular part 36.

Figure 9:
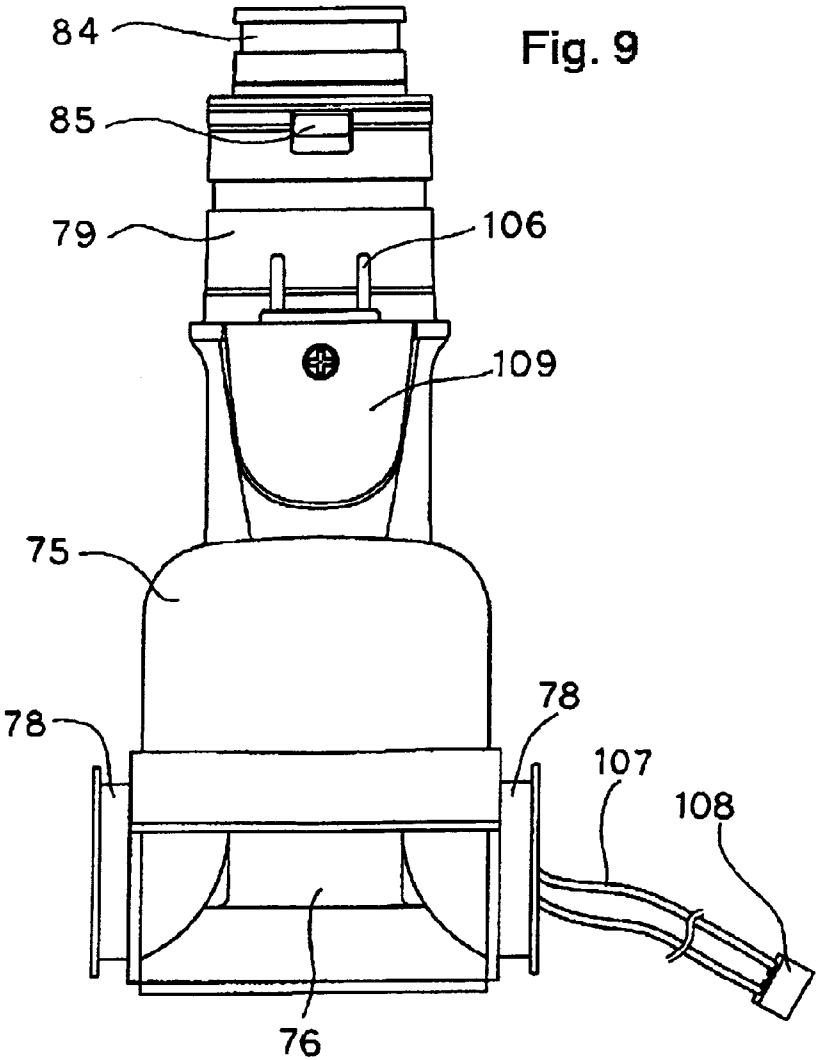
FIG. 9 is a front view of the pivoting pipe and connection pipe of the vacuum cleaner according to an embodiment of the invention.

Referring to FIG. 9, second extension pipe 41 similarly includes a suction tube part 43 having an approximately circular cross-section coinciding with inner tubular part 35, and a crescent-shaped exhaust tube part 45 on its underside that coincides with the crescent shape of outer tubular part 36.

Figure 18:
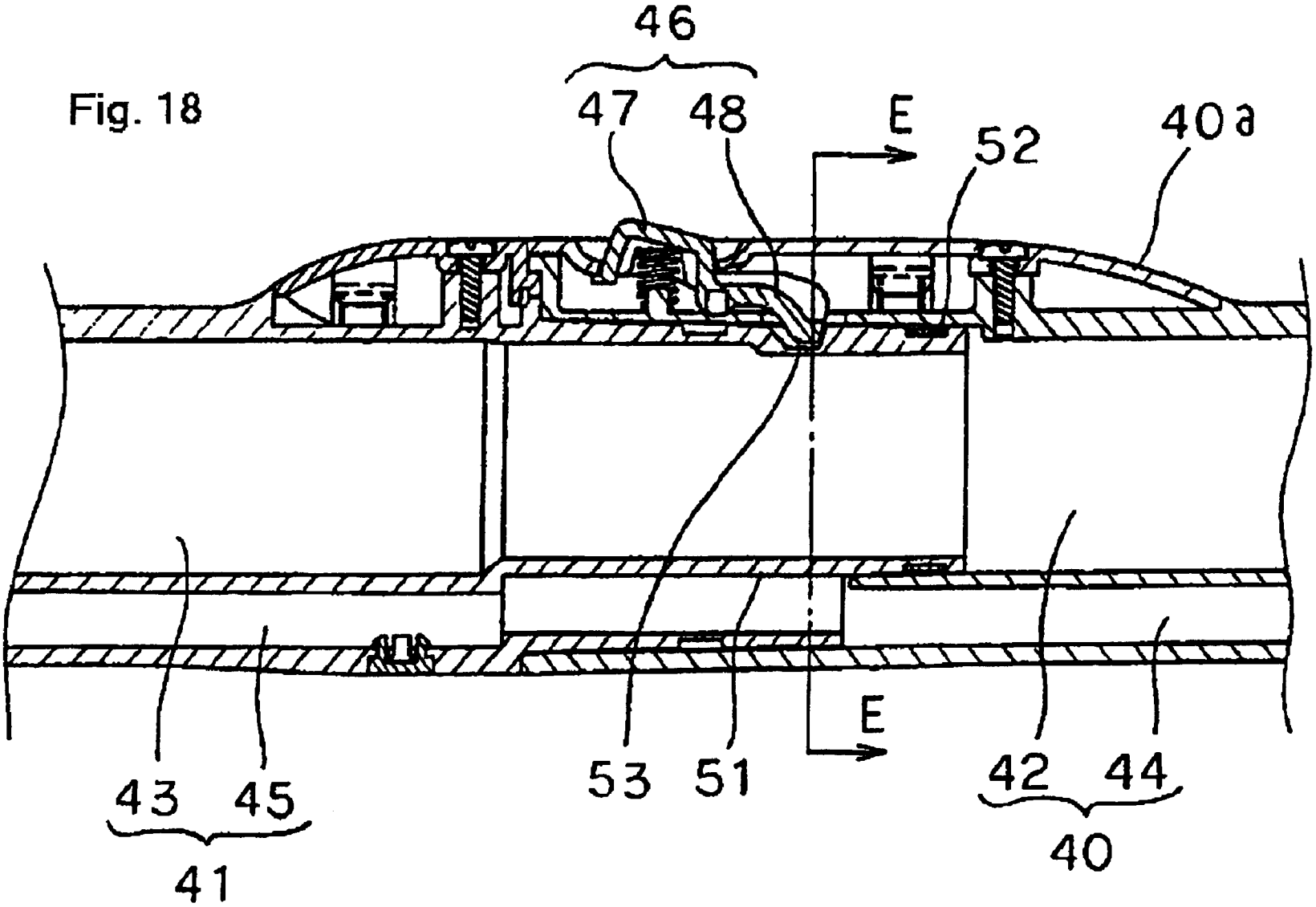
FIG. 18 is a cross-section of the connection portion of the first extension pipe and the second extension pipe.
Figure 19:
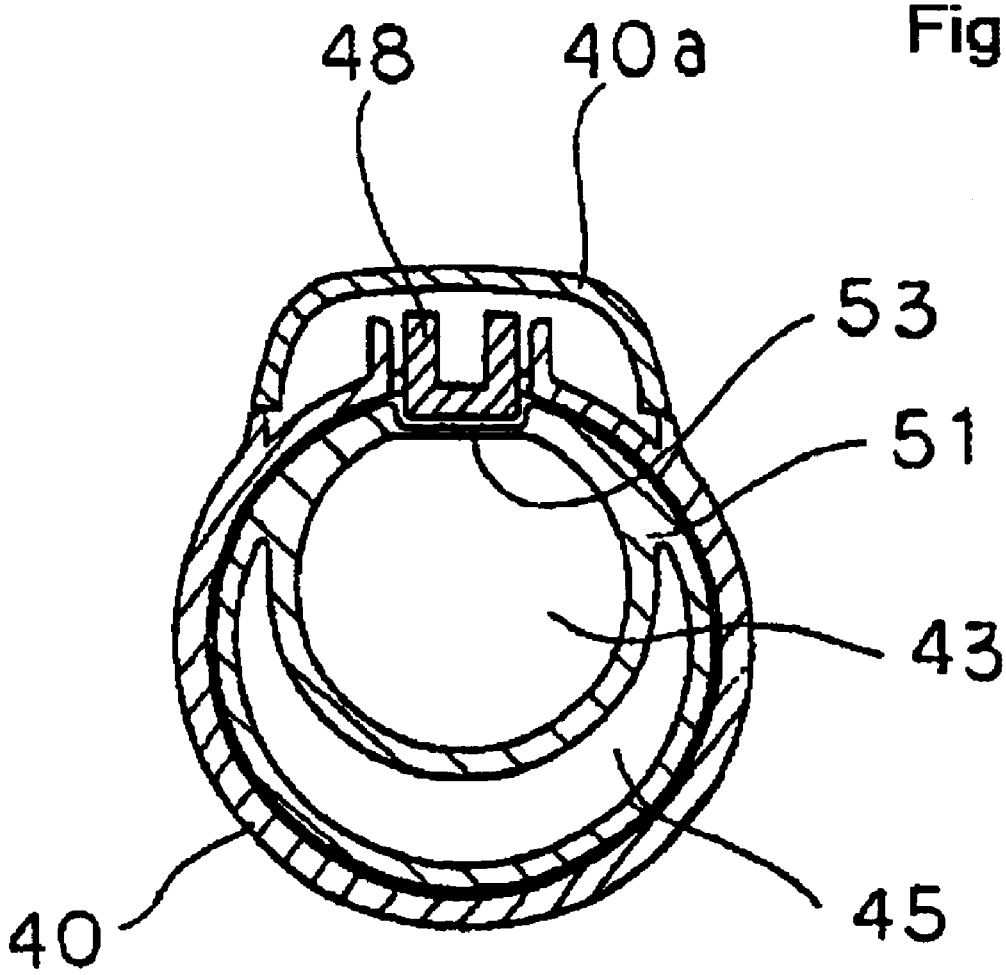
FIG. 19 is a cross-section along line E—E of FIG. 18.

Referring now also to FIG. 18, on the other end of first extension pipe 40 (on the side connecting with second extension pipe 41), a clamp 46 similar to clamp 37 of handle pipe 33 connects first extension pipe 40 to second extension pipe 41. A cover 40*a* is attached unitarily on the outer surface on the side of suction tube part 42. A pushing part 47, or push button, on one end of clamp 46 is exposed through an opening shown at the upper surface of cover 40*a*. A hook 48 on the other end of clamp 46 is spring-biased inward into its normally locking position with a latching depression 53, as shown in FIG. 18. Pushing part 47 is pivoted by the user by pressing on pushing part 47 to lever hook 48 upward out of engagement with latching depression 53.

One end of first extension pipe 40 and second extension pipe 41(on the side connecting with handle tube 33) includes an insertion tube part 50 and an insertion tube part 51 that are inserted into handle tube 33. The other end of first extension pipe 40 is fitted into second extension pipe 41. Packing seals 52 are placed on the outer perimeters of insertion tube part 50 of suction tube part 42 and on insertion tube part 51 of suction tube part 43.

The connection portion for first extension pipe 40 and second extension pipe are shown in FIG. 18 and described in detail. The corresponding connection portion between second extension pipe 41 and a connection pipe 79 of a floor suction tool 54 is the same, and further detailed description thereof is omitted.

Referring now to FIGS. 2–8, a floor suction tool 54 is detachably connected to the outer end of second extension pipe 41. Floor suction tool 54 includes a suction tool body 57. An upper case 55 fits onto a lower case 56. A lid body 68 (described later) detachably latches onto upper case 55 and lower case 56. A pivoting pipe 75 (described later) is sandwiched between upper case 55. Pivoting pipe 75 is pivoted to lower case 56 to permit it to be rotated up and down with respect to suction tool body 57. A connection pipe 79 (described later) that is fitted onto pivoting pipe 75. Connection pipe 79 is free to rotate freely in the circumferential direction.

A suction opening 58 is formed on the lower surface of suction tool body 57. A rotation brush housing chamber 59 is located inside suction tool body 57. A rotation brush 60, facing suction opening 58, is rotationally housed in rotation brush housing chamber 59.

Rotation brush 60 has a core body 61 and a pair of brush bodies 62. Base parts of brush bodies 62 are inserted and attached to a spiral groove on core body 61. A pair of blades 63 have their base parts similarly inserted and attached to the spiral groove of core body 61. Blades 63 are molded in a curved shape preferably from a synthetic resin such as, for example, nylon or polyethylene.

Figure 6:
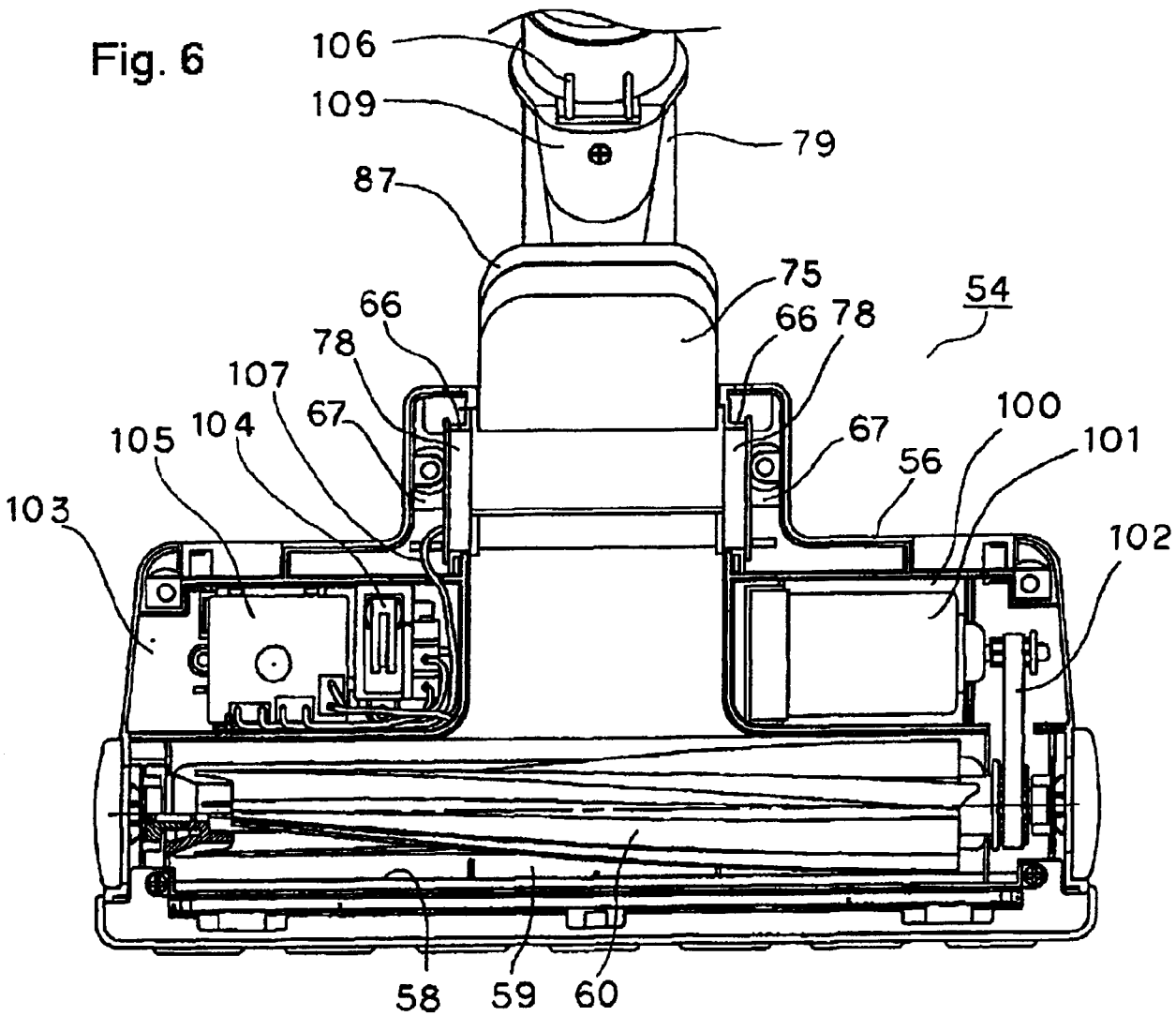
FIG. 6 is a top view of the floor suction tool of FIG. 2 with an upper case and lid body removed.

Referring now to FIG. 6, a motor housing chamber 100 is located inside suction tool body 57 adjacent to rotation brush housing chamber 59. A motor 101 inside motor housing chamber 100 drives a belt 102 to transfer rotational torque from motor 101 to rotation brush 60.

Figure 8:
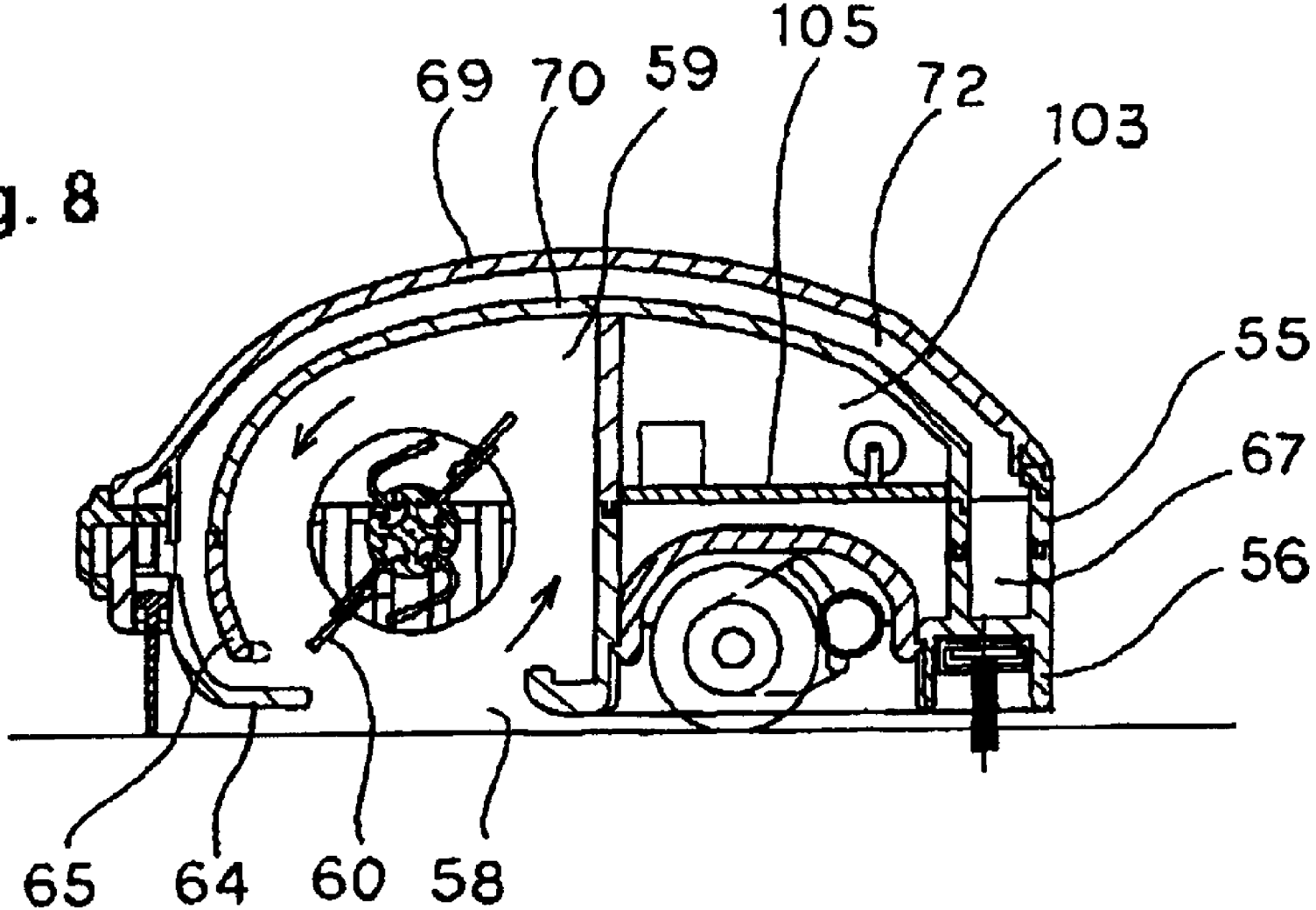
FIG. 8 is a cross-section along line A—A of FIG. 3.

Referring to FIG. 8, motor 101 rotates rotation brush 60 in the counter-clockwise direction, as seen in the FIG. 8. A unidirectional clutch (not shown) constrains the rotation of rotation brush 60 to rotational only in the counter-clockwise direction.

Returning to FIG. 6, a control part housing chamber 103 is provided inside suction tool body 57 on the opposite side of motor housing chamber 100 from motor 101. A safety switch 104 inside control part housing body chamber 103 detects when the bottom surface of suction tool body 57 faces upward. A signal from safety switch 104 enables a control board 105, also located inside control part housing chamber 103, to stop motor 101 when safety switch 104 detects that the bottom surface of suction tool body 57 faces upward.

Figure 7:
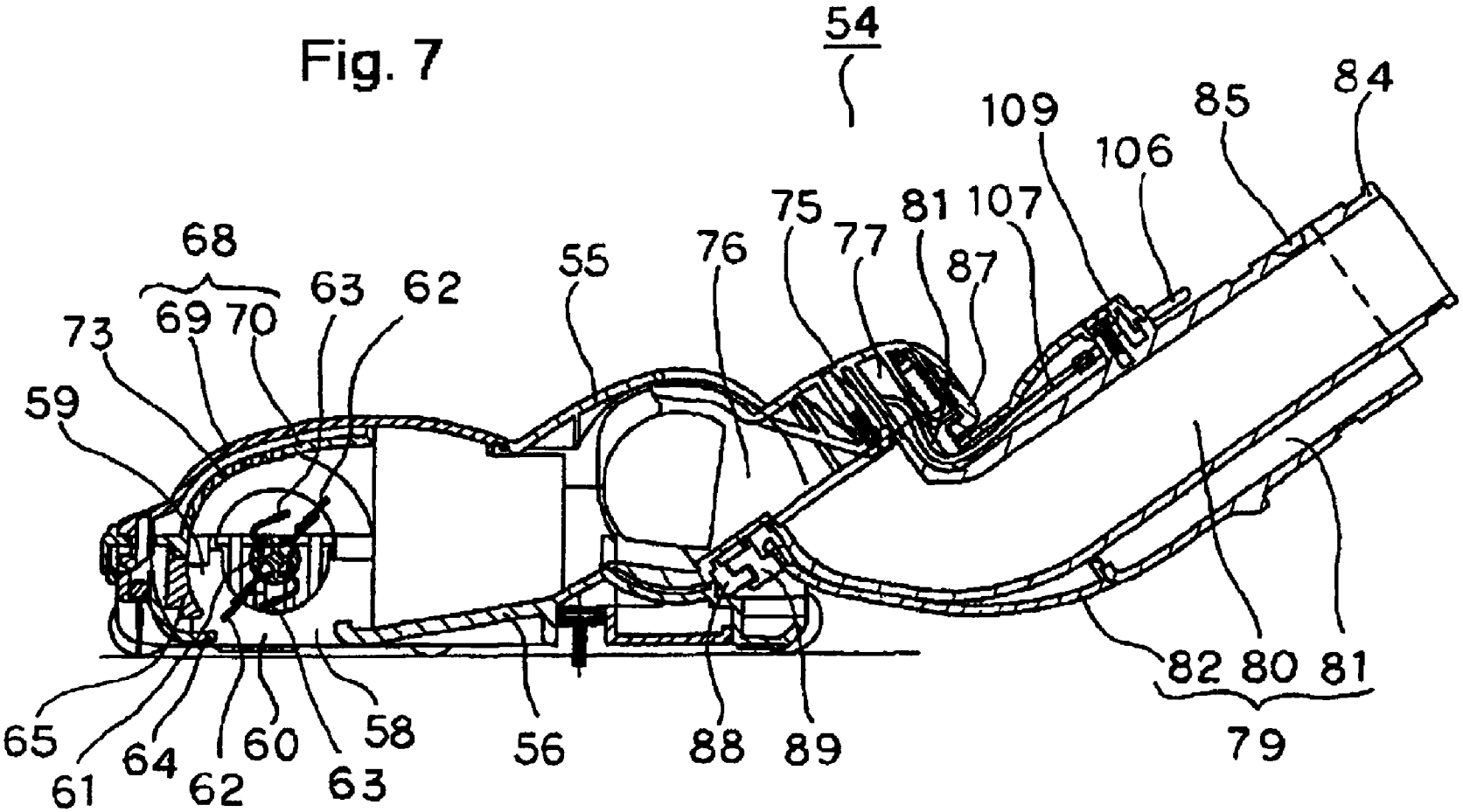
FIG. 7 is a cross-section of the floor suction tool of FIG. 2.

Referring now to FIGS. 7 and 8, a guide part 64 is directed approximately horizontally rearward on the front part of suction opening 58 of lower case 56. A guide member 65 has an inner curved surface forming a continuity of a lower member 70 of a lid body 68, described later. Guide member 65 is placed with space between it and the front wall of lower case 56 and between it and guide part 64. Guide member 65 guides exhaust from a path 72 described later toward guide part 64.

A space between the lower end of guide member 65 and guide member 65 acts as the discharge opening for the circulation path (path 72 that is described later) adjacent to the surface to be cleaned. Locating the exhaust from the circulation path (path 72) at a position adjacent to the surface to be cleaned, and directing the exhaust substantially parallel to the surface being cleaned improves the dislodgement of the dust on the surface to be cleaned, thereby making it easier to take the dust into the vacuum cleaner. As a consequence the cleaning effectiveness is improved.

The exhaust from circulation path 72 is turned by guide part 64 toward rotation brush 60. During the cleaning of a carpet, a reduction in the rotational force due to catching of blade 63 and brush body 62 of rotation brush 60 on the carpet is prevented.

Referring now to FIGS. 6 and 8, an axle supporting part 66 is formed at the back center part of upper case 55 and lower case 56. Axle supporting part 66 pivotably supports a hollow axle 78 of pivoting pipe 75 described later. An exhaust space 67 is formed continuously on axle supporting part 66. Exhaust from motorized fan 6 is guided through hollow axle 78 of pivoting pipe 75 (described later) to exhaust space 67.

Referring now to FIGS. 3–5 and 7–8, lid body 68 is removably attached to upper case 55 and lower case 56. Lid body 68 forms the top panel of rotation brush housing chamber 59. Lid body 68 is constructed from an upper member 69 spaced upward from lower member 70. A pair of expanded parts 71 (FIGS. 3 and 5) are formed near both lateral extremities of upper member 69. That is, expanded parts 71 are located at positions corresponding to the ends of rotation brush 60. Expanded parts 71 protrude upward over the entire front-to-back width of upper member 69. Path 72, through which passes exhaust from exhaust space 67, is formed between expanded parts 71 and lower member 70. In addition, the forward opening of path 72 is the discharge opening for the exhaust.

A large number of small holes 73 (FIG. 7) are formed in the portion corresponding to path 72 of lower member 70. Small holes 73 reduce the noise from air flow inside rotation brush housing chamber 59.

Pivoting pipe 75 allows for pivoting vertical movement with respect to suction tool body 57. Pivoting pipe 75 forms a suction pipe part 76 that is continuous from the end that is connected to a connection pipe 79 (described later) to the other end that is sandwiched by suction tool body 57. An exhaust channel 77 coincides with an exhaust path 81 of connection pipe 79 (described later) on an outer perimeter part of suction pipe part 76 on one end of pivoting pipe 75.

Hollow shaft 78 is formed on the other end of pivoting pipe 75 in communication with exhaust channel 77. By having shaft 78 pivotably supported by axle supporting parts 66, 66 of upper case 55 and lower case 56, exhaust channel 77 of pivoting pipe 75 and exhaust space 67 of suction tool body 57 are in communication.

Connection pipe 79 is connected to pivoting pipe 75 in a manner allowing for pivoting in the circumferential direction. Connection pipe 79 is constructed from a suction path 80 that communicates with suction pipe part 76 of pivoting pipe 75 and an exhaust path 81. Exhaust path 81 is formed unitarily on the outer perimeter of suction path 80 in communication with exhaust tube part 45 of second extension pipe 41. A cover member 82, fitted on a lower portion of connection pipe 79, forms a part of exhaust path 81.

On the side where it connects to second extension pipe 41, exhaust path 81 of connection pipe 79 has a crescent-shaped cross section coinciding with the shape of exhaust tube part 45 of second extension pipe 41. In addition, on the side of connection pipe 79 that connects with pivoting pipe 75, exhaust path 81 surrounds the entire outer perimeter of suction pipe part 76.

As with the end part of second extension pipe 41 on the first extension pipe 40 side and with the end part of first extension pipe 40 connecting with handle pipe 33, an insertion tube part 84 is formed on connection pipe 79 where it connects with second extension pipe 41. Insertion tube part 84 has a latching depression part 85 that latches with hook 48 of clamp 46.

Figure 10:
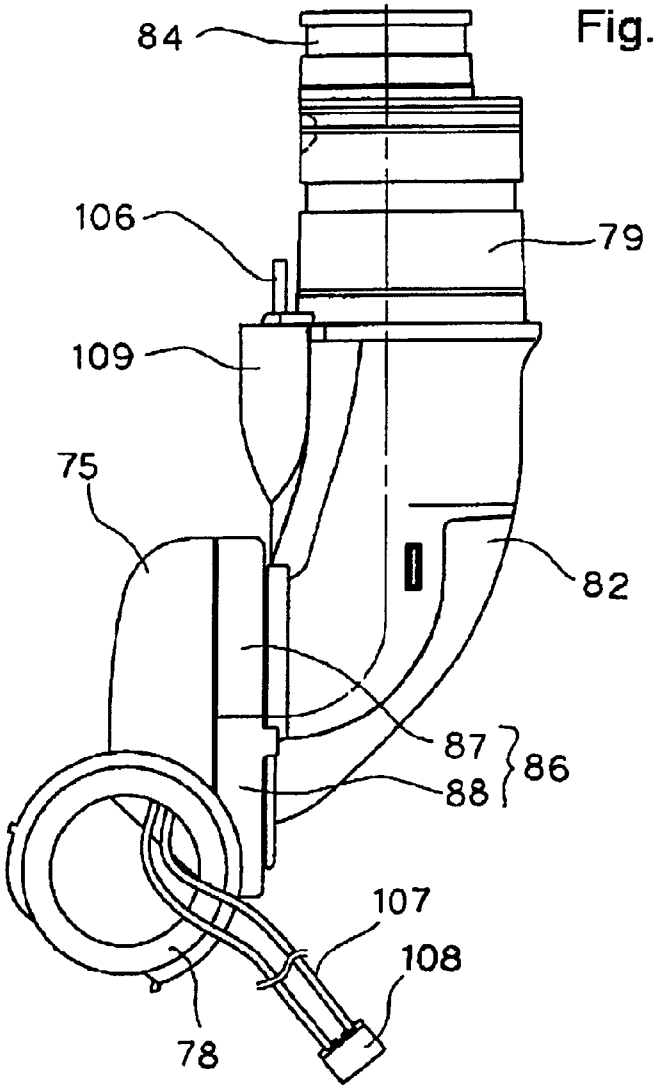
FIG. 10 is a side view of FIG. 9.
Figure 11:
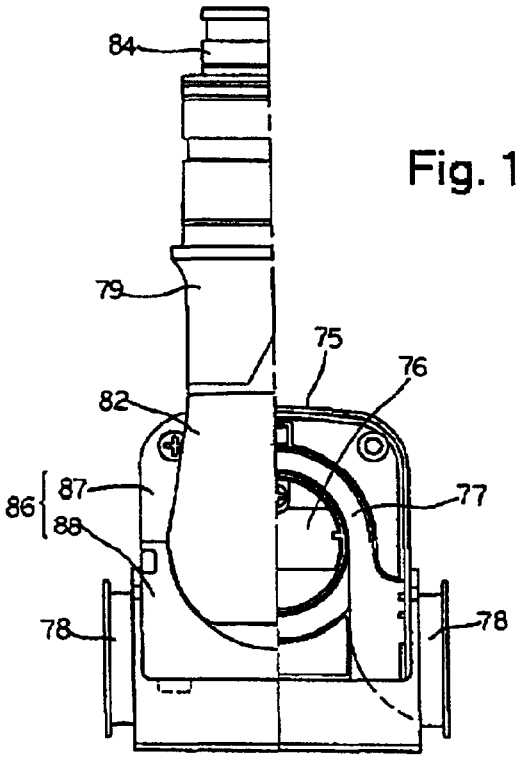
FIG. 11 is a figure simultaneously showing a rear view with the pivoting pipe connected to the connection pipe, as well as the back side of the pivoting pipe.
Figure 12:
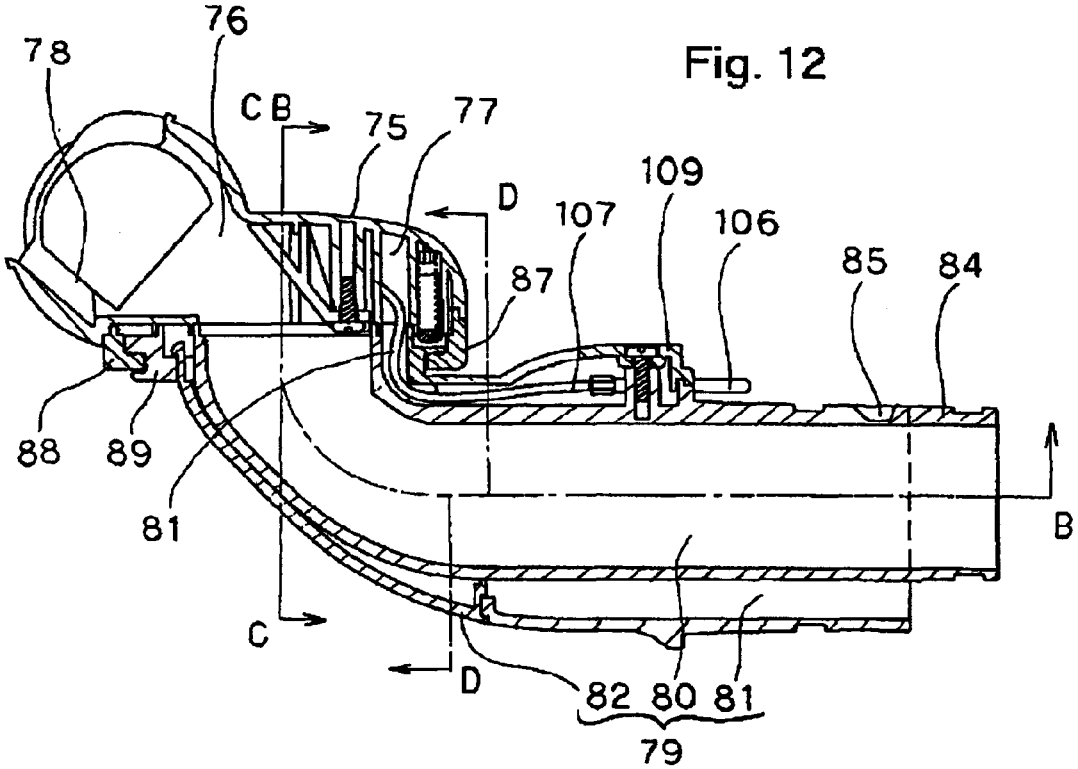
FIG. 12 is a cross-section of the pivoting pipe and connection pipe.
Figure 13:
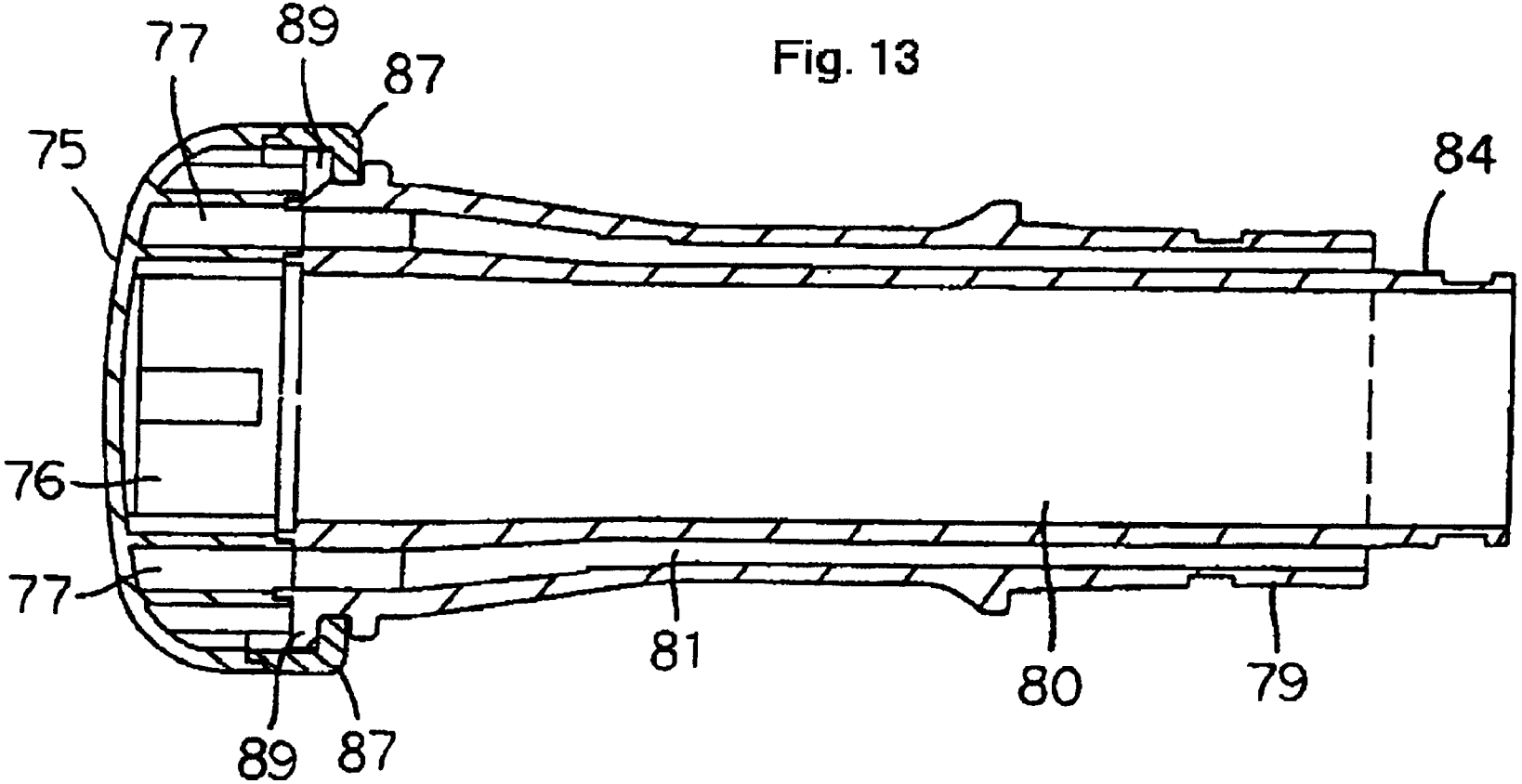
FIG. 13 is a cross-section along line B—B of FIG. 12.
Figure 14:
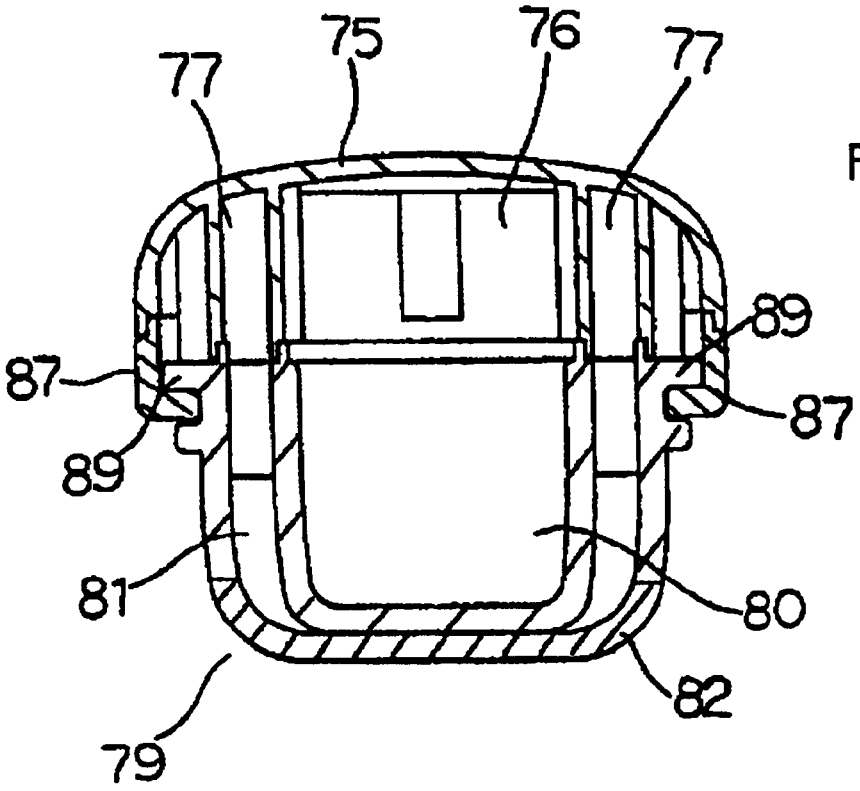
FIG. 14 is a cross-section along line C—C of FIG. 12.
Figure 15:
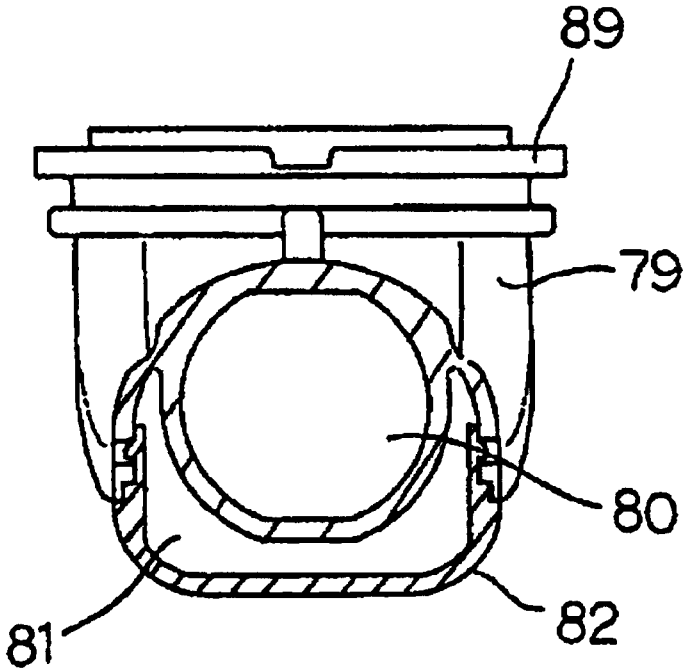
FIG. 15 is a cross-section along line D—D of FIG. 12 with the pivoting pipe removed.
Figure 16:
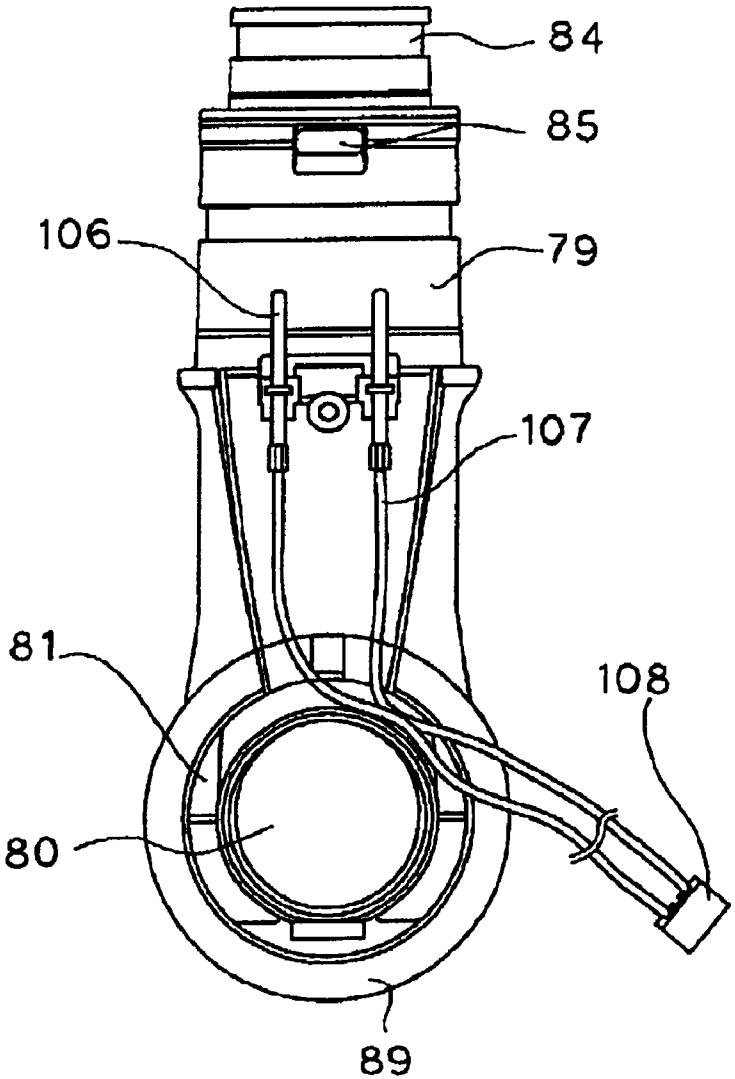
FIG. 16 is a top view of the connection pipe.
Figure 17:
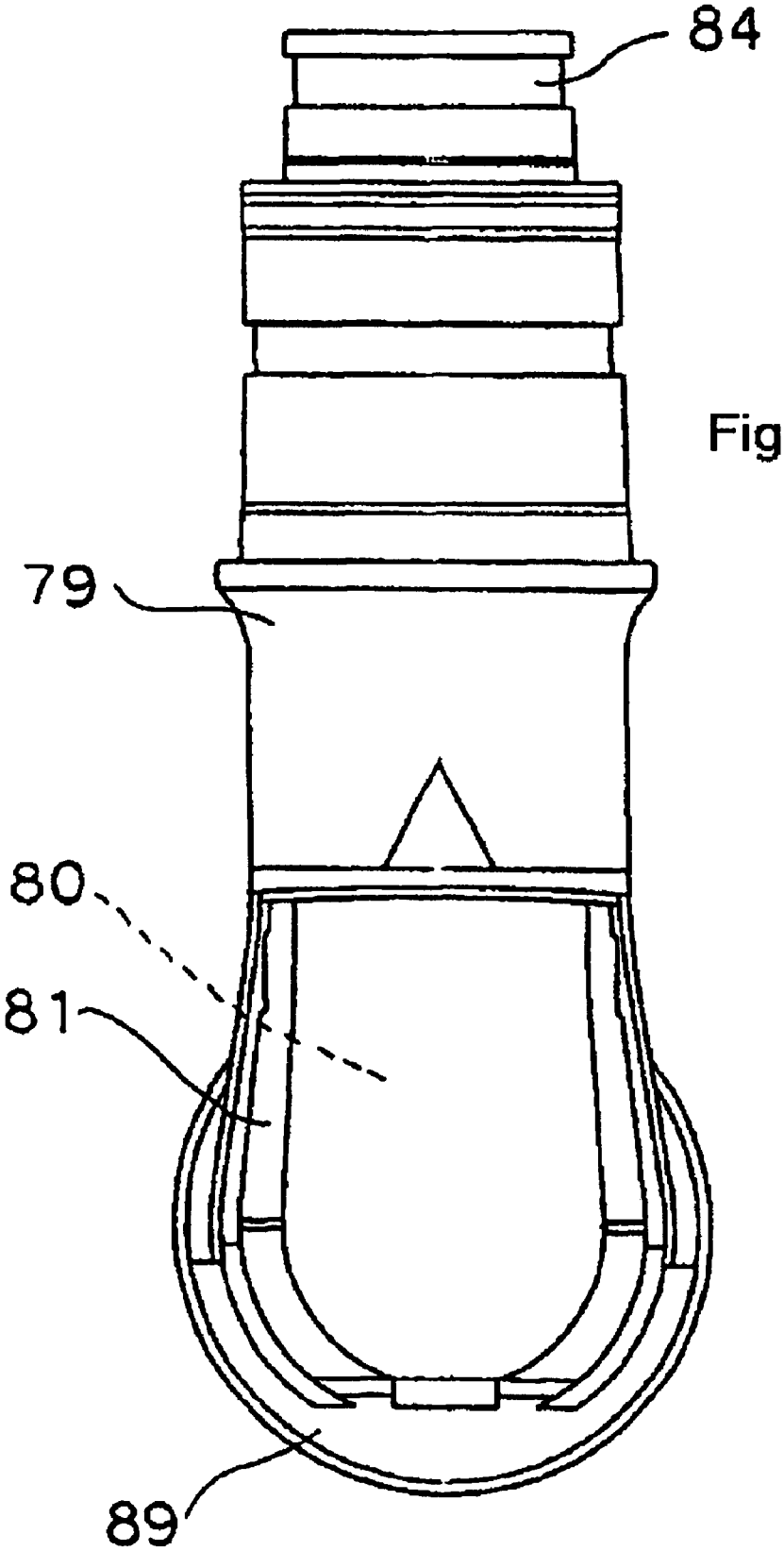
FIG. 17 is a bottom view of the connection pipe.

Referring now to FIGS. 9 and 10, terminals 106 are affixed on the upper surface of connection pipe 75 on the side with second extension pipe 41. Feeder lines 107 have one end connected to terminals 106. A connector 108, connected to the other end of feeder lines 107, is affixed to control board 105. Feeder lines 107 pass through exhaust channel 77, hollow shaft 78, and exhaust space 67 to reach control board 105. To prevent breaking of wire due to pivoting of pivoting pipe 75 and connection pipe 79, feeder lines 107 are wired with more slack than the distance that pivoting pipe 75 and connection pipe 79 pivot.

By connecting connection pipe 75 to second extension pipe 41, terminal 106 is electrically connected to a feeder means (not shown) in second extension pipe 41. A cover body 109 anchors terminal 106 and covers feeder lines 107.

Referring now to FIGS. 9–13, a support cover 86 is attached to one end of pivoting pipe 75. Support cover 86 is made up of an upper support member 87 and a lower support member 88. A rim part 89, at the opening edge of exhaust path 81 of connection pipe 79, is sandwiched between support cover 86 and one end of pivoting pipe 75. Support cover 86 supports pivoting pipe 75 and connection pipe 79 in a freely pivoting manner.

Pivoting pipe 75 can be pivoted upward to a position that is approximately perpendicular with respect to suction tool body 57. In addition, connection pipe 79 can be pivoted in the left-right direction with respect to pivoting pipe 75 to a position approximately horizontal with the floor surface. By pivoting pivoting pipe 75 to the perpendicular position as well as pivoting connection pipe 79 left or right to an approximately horizontal position, first extension pipe 40 and second extension pipe 41 can be positioned roughly parallel to suction tool body 57. Suction tool body 57 can thus penetrate and clean between furniture and the like.

Therefore, with the embodiment of the present invention, when motorized fan 6 is energized, air containing dust is sucked in through suction opening 58 of floor suction tool 54. This air flows into dust collecting chamber 5 through suction pipe part 76 of pivoting pipe 75, suction path 80 of connection pipe 79, suction tube part 42 and suction tube part 43 of first extension pipe 40 and second extension pipe 41, inner tubular part 35 of handle pipe 33, inner member 31, inner hose 25 of second connection member 30, and inner member 28 of first connection member 27.

After filtering the dust contained in the suction air by paper pack 4, a large portion of the suction air is circulated as exhaust from the fan portion of motorized fan 6 to exhaust path 17 through first opening 11 of motor cover 10 and return opening 15 of motorized fan chamber 7 bottom surface. In addition, a portion of the suction air from the motor part of motorized fan 6 is discharged from the axle portion of wheel 14 through second opening 12 of motor cover 10 and filter 13.

A large portion of the exhaust circulated to exhaust path 17 flows between inner member 28 and outer member 29 of first connection member 27 via communication hole 23 formed on partitioning wall 22 of body case 2, exhaust space 19 between body case 2 and front cover 18, communication opening 21 formed on hose connection tube part 20 of front cover 18.

After passing through the exhaust path between inner hose 25 and outer hose 26 that are each connected to inner member 28 and outer member 29 of first connection member 27, the exhaust flows inside outer tubular part 36 of handle pipe 33 in the space between inner member 31 and outer member 32 of second connection member 30. The exhaust further flows into exhaust path 81 of connection pipe 79 of floor suction tool 54 via exhaust tube part 44 and exhaust tube part 45 of first extension pipe 40 and second extension pipe 41.

The exhaust that flows into exhaust path 81 of connection pipe 79 passes through exhaust channel 77 of pivoting pipe 75 via hollow shaft 78 and through exhaust space 67 of suction tool body 57. The exhaust collides with guide part 64 via path 72 on expanded parts 71 of lid body 68. The exhaust is blown toward rotation brush 60 to rotate rotation brush 60.

Furthermore, because guide member 65 is continuous with lower member 70 of lid body 68 that defines path 72 and adjoins guide part 64, the exhaust from path 72 is prevented from being dispersed inside rotation brush housing chamber 59. The exhaust is more accurately guided to rotation brush 60, and rotational force of rotation brush 60 is efficiently obtained.

When cleaning a carpet with long fibers and the like, there may be insufficient rotation torque with the only rotational force on rotation brush 60 generated by the exhaust circulated to suction tool body 57. Dust embedded deep inside the fibers of the carpet and the like may not be sufficiently removed. In this situation, motor 101 is operated, and rotation brush 60 is forcibly rotated. When this occurs, the exhaust that collides with guide part 64 has its direction changed, so that it is guided in the direction of the rotation of rotation brush 60. This aids the rotation of rotation brush 60 and reduces the load on motor 101. In addition, this assistance permits motor 101 to be made smaller.

Feeder lines 107, to control board 105, pass through exhaust channel 77, hollow axle 78, and exhaust space 67. This eliminates the need for special provisions for the wiring. The construction is thus simplified. In addition, because feeder lines 107 pass through exhaust channel 77, hollow axle 78, and exhaust space 67, where the flowing air has passed through paper pack 4, and is relatively clean, damage to coverings or short circuits of feeder lines 107 arising from contamination by dust and the like is prevented, and clogging of the path due to trapping of dust and the like on feeder lines 107 is prevented.

Clamps 46, which are placed in the connection parts between handle pipe 33 and first extension pipe 40, between first extension pipe 40 and second extension pipe 41, and between second extension pipe 41 and connection pipe 79 of floor suction tool 54, are all located on the suction side of the path from floor suction tool 54 to vacuum cleaner body 1. As a result, outflow of air to the atmosphere from the hole where the pushing part of clamp 46 faces out. The user does not feel any discomfort.

Using the connection portion between first extension pipe 40 and second extension pipe 41 as an example, if pushing part 47 of clamp 46 were placed on the same side as exhaust tube 44, exhaust flowing inside exhaust tube part 44 could leak to the outside of first extension pipe 40 through opening 49 where hook 48 of clamp 46 faces out. The user may feel some discomfort. However, in the present embodiment, clamp 46 is placed on the side with suction tube part 42, which is the suction path from floor suction tool 54 to vacuum cleaner body 1. As a result, due to sub-atmospheric pressure in the suction flow that is inside suction tube part 42 and flows by being sucked in by motorized fan 6, outside air is sucked inside suction tube part 42 via opening 49 where hook 48 of clamp 46 faces out. Leakage of air from first extension pipe 40 is prevented, and the user does not experience any discomfort.

Furthermore, in motor 101, safety switch 104 detects when the bottom surface of suction tool body 57 faces upward, and the control part stops motor 101. As a result, injury from touching rotation brush 60 with the hand is prevented.

Path 72 of lid body 68 is formed at a position corresponding to both ends of rotation brush 60. As a result, the exhaust circulating in path 72 is blown mainly onto the ends of rotation brush 60 via guide part 64.

The suctioning force of the vacuum cleaner is strongest at the center of suction opening 58, corresponding to suction pipe part 76 of pivoting pipe 75 that is connected to the back center part of suction tool body 57. However, in the present embodiment as described above, because exhaust is blown toward the ends of rotation brush 60, dust at the ends of rotation brush 60, where the suction force is relatively weak compared to the center part of suction opening 58, is reliably stirred up.

Because the discharge opening for path 72 is formed towards the front of floor suction tool 54 (in other words, on the front side of rotation brush housing chamber 59), the exhaust that flows from the back towards the front of floor suction tool 54 is guided smoothly from the front of rotation brush housing chamber 59, around towards the bottom, and then toward the back. This prevents reduction of wind speed, and improves the suctioning force for deep parts.

The discharge opening of path 72 is provided with guide member 65, and the discharge opening for the exhaust from path 72 is close to the surface to be cleaned. As a result, the exhaust from path 72 is aligned and blown onto guide part 64. Reduction in wind speed is prevented, and rotational torque of rotation brush 60 is reliably obtained. In addition, dust from the surface to be cleaned is churned up, whereby the suctioning performance is improved.

According to the present invention, placing the feeder lines to the motor that rotates the rotation brush in the circulation path that circulates exhaust air to the floor suction tool, the construction of the floor suction tool is simplified.

Because the feeder lines are wired in the circulation path where the air flow is relatively clean, damage to the coating of the feeder lines due to collision of dust with the feeder lines is prevented. Thus, short circuiting of the feeder lines is prevented. In addition, clogging of the channels due to trapping of dust and the like on the feeder lines is prevented, since the air flowing in the channels has passed through a filter, and is relatively clean.

According to a further embodiment of the present invention, because the amount of slack in the feeder lines is greater than the pivoting distance of the pivoting pipe and the connection pipe, breaking of the wires of the feeder lines due to pivoting of the pivoting pipe and connection pipe is prevented.

According to a still further embodiment of the present invention, exhaust air circulating in the floor suction tool is guided in the direction of the rotation of the rotation brush. As a result, the exhaust air aids in driving the rotation brush when the motor is operated, and thus decreases the load on the motor. A smaller motor can be used.

Having described preferred embodiments of the present invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electric vacuum cleaner having a vacuum cleaner body containing a dust collecting chamber and a motorized fan with an exhaust outlet and a suction outlet and comprising:

an elongated hose device having an inner hollow hose disposed in spaced apart relationship with an outer hollow hose;

a single means connected to one end of said hose device for connecting the inner hollow hose to the suction inlet of the fan and connecting the outer hollow hose to the exhaust outlet of the fan;

an elongated extension pipe device having an inner hollow conduit disposed in spaced relationship within an outer hollow conduit, one end of the pipe device being connected to the other end of the hose device with the inner conduit connected to the inner hollow hose and thus connected by the inner hollow hose to the suction inlet of the fan and the outer conduit connected to the outer hollow hose and thus being connected to the exhaust outlet of the fan;

a floor suction tool connected to the other end of the pipe device, said floor suction tool having a suction port connected to the inner hollow conduit of the pipe device and thus being connected to the suction inlet of the fan, said floor suction tool having an exhaust port connected to the outer hollow conduit of the pipe device and thus being connected to the exhaust outlet of the fan and forming an exhaust path;

an air filter in said exhaust path wherein said air filter is disposed externally to said dust collecting chamber and located upstream of an exhaust air discharge part of the vacuum cleaner body; and said floor suction tool containing a rotation brush and a motor for rotating said brush.

2. The electric vacuum cleaner according to claim 1, comprising:

said exhaust path disposed in said vacuum cleaner body to guide an exhaust of said motorized fan into said outer hollow hose;

a path disposed in said outer hollow hose to communicate with said exhaust path in said vacuum cleaner body;

a path disposed in said elongated extension pipe device to communicate with said path in said outer hollow hose;

a path disposed in said floor suction tool to communicate with said path in said elongated extension pipe device; said paths constituting an air circulation guide path passing from said vacuum cleaner body along said outer hollow hose and said elongated extension pipe device to said floor suction tool;

said exhaust guided to said rotation brush in a direction to add a rotation force to said rotation brush;

said air filter adapted to provide that the air in said guide path is clean air; and electric lines from said vacuum cleaner body to said motor for supplying electricity for rotating said rotation brush, said electric lines passing along said air circulation guide path whereby said electric lines are protected from contaminants in air moving therepast.

3. The electric vacuum cleaner according to claim 2, wherein the air in said exhaust path is directed in said floor suction tool toward said rotation brush in a direction to augment rotation of said rotation brush.

4. The electric vacuum cleaner according to claim 2, wherein: said floor suction tool includes a suction tool body, a pivoting pipe movable up and down with respect to said suction tool body, a connection pipe pivotable in a circumferential direction with respect to said pivoting pipe;

said exhaust path passing through said tool body, said pivoting pipe and said connection pipe;

said electric lines passing along said pivoting pipe and said connection pipe;

said electric lines have a slack in the vicinity of said pivoting pipe and said connection pipe; and said slack exceeding a pivoting distance of said pivoting pipe and said connection pipe.

5. The electric vacuum cleaner according to claim 4, wherein:

said electric lines from said pivoting pipe to said connection pipe for supplying electricity for rotating said rotation brush, passing along said exhaust path wherein air moving therepast is clean air.

* * * * *